US007463165B1

(12) United States Patent
Hessing

(10) Patent No.: US 7,463,165 B1
(45) Date of Patent: Dec. 9, 2008

(54) DIRECTIONAL BACK-UP ALARM

(75) Inventor: Dale C. Hessing, Eagle, ID (US)

(73) Assignee: Preco Electronics, Inc., Boise, ID (US)

( * ) Notice: Subject to any disclaimer, the term of this patent is extended or adjusted under 35 U.S.C. 154(b) by 286 days.

(21) Appl. No.: 11/469,316

(22) Filed: Aug. 31, 2006

Related U.S. Application Data

(60) Provisional application No. 60/713,285, filed on Aug. 31, 2005.

(51) Int. Cl.
*G08G 1/16* (2006.01)

(52) U.S. Cl. ..... 340/903; 340/901; 340/904; 340/435; 340/943; 340/932.2

(58) Field of Classification Search ..... 340/425, 340/943, 932.2, 435–438, 903–904; 367/93, 367/94; 381/77
See application file for complete search history.

(56) References Cited

U.S. PATENT DOCUMENTS 3,474,400 A * 10/1969 Auer, Jr. et al. ..... 367/93
5,198,800 A * 3/1993 Tozawa et al. ..... 340/573.1
5,859,915 A * 1/1999 Norris ..... 381/75
5,889,870 A * 3/1999 Norris ..... 381/77
6,011,855 A * 1/2000 Selfridge et al. ..... 381/111
6,016,351 A 1/2000 Raida et al.
6,052,336 A * 4/2000 Lowrey, III ..... 367/139
6,151,398 A 11/2000 Norris
6,229,899 B1 * 5/2001 Norris et al. ..... 381/77
6,535,612 B1 3/2003 Croft, III et al.
6,577,738 B2 * 6/2003 Norris et al. ..... 381/77
6,606,389 B1 * 8/2003 Selfridge et al. ..... 381/111
6,759,954 B1 * 7/2004 Myron et al. ..... 340/522
6,771,785 B2 8/2004 Pompei
6,775,388 B1 8/2004 Pompei
6,914,991 B1 7/2005 Pompei
6,934,402 B2 8/2005 Croft, III et al.
7,016,508 B1 * 3/2006 Phelps ..... 381/77
7,148,794 B2 * 12/2006 Stigall ..... 340/456
7,167,082 B2 * 1/2007 Stigall ..... 340/407.1
7,272,073 B2 * 9/2007 Pellegrini et al. ..... 367/124
2005/0220311 A1 * 10/2005 Sun et al. ..... 381/77
2007/0211574 A1 * 9/2007 Croft, III ..... 367/197

* cited by examiner

*Primary Examiner*—George A Bugg
*Assistant Examiner*—Son M Tang
(74) *Attorney, Agent, or Firm*—Townsend and Townsend and Crew LLP; Kenneth R. Allen

(57) ABSTRACT

A directional back-up alarm deployed in a vehicle moving in an open space, in accordance with one embodiment of the present invention includes, in part, a first ultrasonic generator adapted to generate a first ultrasound signal; a second ultrasonic generator adapted to generate a second ultrasound signal; an audible sound generator adapted to generate an audible signal; a modulator adapted to modulate the first ultrasonic signal with the audible signal to generate a modulated signal; and a summing circuit adapted to receive and sum the modulated signal with the second ultrasonic signal to generate a combined signal. The combined signal is transmitted with a transmit antenna. The transmit antenna may include a Piezoelectric or silicon device.

6 Claims, 1 Drawing Sheet

DIRECTIONAL BACK-UP ALARM

CROSS-REFERENCES TO RELATED APPLICATIONS

The present application claims benefit under 35 USC 119 (e) of U.S. provisional application No. 60/713,285, filed Aug. 31, 2005, entitled "Directional Back-Up Alarm", the content of which is incorporated herein by reference in its entirety.

BACKGROUND OF THE INVENTION

The present invention relates to sound systems, and more particularly to sound alarm systems that warn workers or by-standers in the path of a moving equipment.

Movement based alarms, such as back-up warning alarms, have been used for many years to warn people in the work area around a vehicle or moving equipment to prevent injuries and deaths while the vehicle or equipment is in motion. Many work vehicles are equipped with motion alarms to provide a warning for workers since while moving there are often blind spots limiting the operators ability to react when people may be in the path of the vehicle. Back-up alarms have been and continue to be an effective and recognized safety device.

Two primary issues of concern with movement warning alarms are addressed with this invention. First is the environment. Noise pollution is a growing concern and with increasing population densities and very large construction activities in highly populated areas or many other work sites near populated areas, particularly when operations continue into the night. Work place noise pollution is an emerging issue. Secondly, since back-up alarms have been in use for decades now and with most off-road working vehicles using the equipment, there is a trend to become desensitized to them.

For the two reasons above there would be a significant advantage in having a device that only warns those that are actually in danger and minimizing any noise generated in other areas. It is desired that such device direct sound to a specific area, thereby to reduce ambient noise. Accordingly, when a person hears the sound generated by such device, the person will recognize the immediacy of danger.

SUMMARY OF THE INVENTION

A directional back-up alarm deployed in a vehicle moving in an open space, in accordance with one embodiment of the present invention includes, in part, a first ultrasonic generator adapted to generate a first ultrasound signal; a second ultrasonic generator adapted to generate a second ultrasound signal; an audible sound generator adapted to generate an audible signal; a modulator adapted to modulate the first ultrasonic signal with the audible signal to generate a modulated signal; and a summing circuit adapted to receive and sum the modulated signal with the second ultrasonic signal to generate a combined signal. The combined signal is transmitted with a transmit antenna. The transmit antenna may include a Piezoelectric or silicon device.

DETAILED DESCRIPTION OF THE INVENTION

Figure 1:
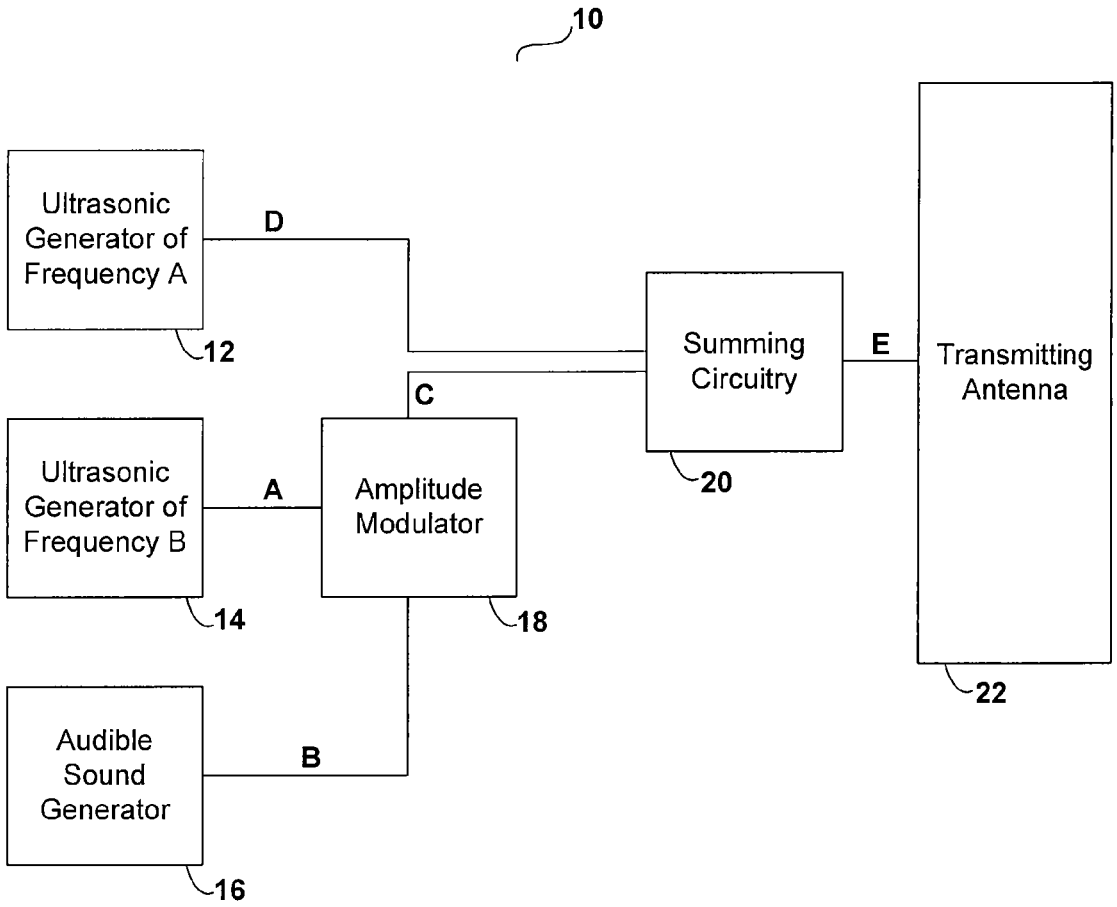
FIG. 1 is a block diagram of a directional back-up alarm system, in accordance with one embodiment of the present the invention.

In accordance with the present invention a sound generating transducer is used with dimensional characteristics proportional to the wavelength of sound generated. As the size of the acoustic radiator element increases relative to the wavelength being generated, the directionality increases. The governing equation for half power beam width assuming a line source is:

$$2\theta = 2\sin^{-1}\left(\frac{1.391558}{0.5kL}\right)$$

Where k is the wave number defined as $$\frac{2\pi}{\text{wavelength}}$$

and L is the length of line source.

The half power beam width is the point at which the sound pressure level has dropped by one-half. This characteristic implies that the sound is louder directly in-line with the transducer and decreases as you move away from the 0 degree point. What is needed for directionality is somewhat arbitrary based on the user's needs and perception. The directionality has different needs under different circumstances. As an example, assume that a single tone of 1 kHz is being transmitted. For a half beam angle under 10 degrees a source greater than 3 feet would be needed. Although physically possible to produce, application in many situations would be difficult.

For size and application needs using a source that is relatively small would make the usefulness of the device much better. Moving the example frequency to 50 kHz for example reduces the needed aperture to 1/50 of the previous example. At this frequency much more can be done to improve the directionality both through aperture opening and employing transducer arrays. The obvious problem is making the sound audible. To accomplish the audible warning, however, the waves used for directionality are used to modulate the warning tone since as mentioned the carrier frequency is outside of the audible range. This implies that an additional device or method is necessary to demodulate the transmitted signal to the audible range. One form of this is through modulating the audible warning sound with an ultrasonic carrier. Under certain circumstances, the high amplitude complex waveform is effectively demodulated due to non-linear properties of air itself. The advantage of using the higher frequency methods is that the physical size of the transducer can be much smaller. The specifics of this type of demodulation are covered in the field of non-linear acoustics. There is a body of related art both in the public domain and in filed patents. The base technology was developed decades ago originally by naval researchers and improvements have been being made since then. The present invention is an application of that base technology.

The invention thus applies the properties of coherent wave front physics to generate audible localized warnings for use on moving equipment. These warnings are intended to warn those in the path of the movement while not needlessly annoying or confusing those that are not in the path. An audible alarm produces a warning sound primarily in the area of danger while being significantly quieter in other areas promoting enhanced work site safety while reducing unnecessary ambient noise. This is accomplished through use of directional ultrasonic transmitters with a narrow cone angle. Using two of these with a frequency difference in audible region becomes audible through non-linear demodulation effects.

FIG. 1 is a simplified high-level diagram of various blocks disposed in a directional back-up alarm system (alternatively referred to herein below as alarm system) 10, in accordance with one embodiment of the present invention. Alarm system 10, which is deployed in a moving vehicle, is shown as including, in part, two ultrasonic sound generators 12, 14, an audible sound generator 16, an amplitude modulator 18, a summing circuit 20, and a transmit antenna 22. In one exemplary embodiment, ultrasonic sound generators 12 and 14 may have frequencies of 48 KHz and 50 KHz, respectively.

Amplitude modulator 18 modulates the amplitude of the ultrasonic signal A, generated by ultrasonic sound generator 14, with the audible sound B, generated by audible sound generator, to generate amplitude modulated signal C. Summing circuit 20 sums signal C to ultrasonic sound D (generated by ultrasonic sound generator 12) and, in response, generates combined signal E. Combined signal E contains the frequency spectrum of both signals B and D and is transmitted by transmit antenna 22. Transmit antenna 22 may include a Piezoelectric or silicon device.

As the alarm system 10 transmits, the transmitted signal is demodulated by air and an audible sound with a frequency defined by the difference of the ultrasonic sounds B and D is generated at the target location for reception and hearing by the by-standers. For example, if ultrasonic signals A and D have respective frequencies of 48 KHz and 50 KHz, the air demodulated signal has a frequency of 2 KHz. Furthermore, because one of the ultrasonic signals A is modulated by an audible sound, the air demodulated signal has an additional spectral content defined by the frequency of the audible sound.

The physical realization of the various embodiments can be in a conventional back-up alarm footprint. Other realizations may include warning systems used for a variety of transportation systems ranging from airports to buses. The warning technique according to the invention may also be used in conjunction with other types of warnings including voice and emergency sirens.

The above embodiments of the present invention are illustrative and not limiting. Various alternatives and equivalents are possible. The invention is not limited by the type of signal generator, amplitude modulator, summing circuitry or transmit antenna. The invention is not limited by the type of integrated circuit used. Nor is the disclosure limited to any specific type of process technology, e.g., CMOS, Bipolar, or BICMOS that may be used to manufacture parts or the entirety of the present disclosure. Other additions, subtractions or modifications are obvious in view of the present disclosure and are intended to fall within the scope of the appended claims.

What is claimed is:

1. A directional back-up alarm for use in a vehicle moving in an open space, the directional back-up alarm comprising:

a first ultrasonic generator adapted to generate a first ultrasound signal;

a second ultrasonic generator adapted to generate a second ultrasound signal;

an audible sound generator adapted to generate an audible signal;

a modulator adapted to modulate the first ultrasonic signal with the audible signal to generate a modulated signal; and a summing circuit adapted to receive and sum the modulated signal with the second ultrasonic signal to generate a combined signal, a transmit antenna adapted to transmit the combined signal into a vehicle back-up open space.

2. The directional back-up alarm of claim 1 wherein the transmit antenna includes a Piezoelectric device.

3. The directional back-up alarm of claim 1 wherein the transmit antenna includes a silicon device.

4. A method of producing an audible alarm from a vehicle moving in an open space, the method comprising:

generating a first ultrasound signal;

generating a second ultrasound signal;

generating an audible signal;

modulating the first ultrasonic signal with the audible signal to generate a modulated signal; and summing the modulated signal with the second ultrasonic signal to generate a combined signal, transmitting the combined signal over the air in the vehicle moving open space.

5. The method of claim 4 wherein the combined signal is transmitted via a transmit antenna that includes a Piezoelectric device.

6. The method of claim 5 wherein the combined signal is transmitted via a transmit antenna that includes a silicon device.

* * * * *